US008563498B2

(12) United States Patent
Gizaw et al.

(10) Patent No.: US 8,563,498 B2
(45) **Date of Patent: *Oct. 22, 2013**

(54) FABRIC CARE COMPOSITIONS COMPRISING COPOLYMERS

(75) Inventors: Yonas Gizaw, West Chester, OH (US); Matthew Lawrence Lynch, Mariemont, OH (US); Valentin Cepus, Glashuetten (DE); Travis Kyle Hodgdon, Cincinnati, OH (US); Marcia Mary Ketcha, Cincinnati, OH (US); Lorenzo Matteo Pierre Gualco, Brussels (BE); Dieter Boeckh, Limburgerhof (DE); Christofer Arisandy, Mannheim (DE); Fleumingue Jean-Mary, West Chester, OH (US); Frank Hulskotter, Bad Duerkheim (DE); Phillip Kyle Vinson, Fairfield, OH (US); Jodi Lee Brown, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 215 days.

This patent is subject to a terminal disclaimer.

(21) Appl. No.: 13/078,067

(22) Filed: Apr. 1, 2011

(65) Prior Publication Data

US 2011/0245142 A1 Oct. 6, 2011

Related U.S. Application Data

(60) Provisional application No. 61/320,032, filed on Apr. 1, 2010.

(51) Int. Cl.
*C11D 3/37* (2006.01)

(52) U.S. Cl.
USPC ..... 510/475; 510/527

(58) Field of Classification Search
USPC ..... 510/475, 527
See application file for complete search history.

(56) References Cited

U.S. PATENT DOCUMENTS

| | | | | |
|---|---|---|---|---|
| 4,081,384 | A | 3/1978 | Pracht | |
| 4,234,627 | A | 11/1980 | Schilling | |
| 4,514,461 | A | 4/1985 | Woo | |
| RE32,713 | E | 7/1988 | Woo | |
| 4,806,345 | A | 2/1989 | Bhattacharyya | |
| 4,882,220 | A | 11/1989 | Ono et al. | |
| 4,917,920 | A | 4/1990 | Ono et al. | |
| 5,114,600 | A * | 5/1992 | Biggin et al. | 510/522 |
| 5,145,842 | A | 9/1992 | Driedger et al. | |
| 5,500,137 | A | 3/1996 | Bacon et al. | |
| 5,500,138 | A | 3/1996 | Bacon et al. | |
| 5,500,154 | A | 3/1996 | Bacon et al. | |
| 5,574,179 | A | 11/1996 | Wahl et al. | |
| 5,780,404 | A | 7/1998 | Bacon et al. | |
| 6,194,375 | B1 | 2/2001 | Ness et al. | |
| 6,200,949 | B1 | 3/2001 | Reijmer et al. | |
| 6,491,728 | B2 | 12/2002 | Bacon et al. | |
| 6,620,777 | B2 | 9/2003 | Heibel et al. | |
| 6,645,479 | B1 | 11/2003 | Shefer et al. | |
| 6,815,069 | B2 | 11/2004 | Hohberg et al. | |
| 6,864,223 | B2 | 3/2005 | Smith et al. | |
| 7,119,057 | B2 | 10/2006 | Popplewell et al. | |
| 7,153,924 | B2 | 12/2006 | Kuepfer et al. | |
| 7,321,019 | B2 | 1/2008 | Ziche | |
| 7,427,648 | B2 | 9/2008 | Ochs et al. | |
| 7,659,238 | B2 * | 2/2010 | Martin et al. | 510/515 |
| 2003/0158344 | A1 | 8/2003 | Rodriques et al. | |
| 2003/0165692 | A1 | 9/2003 | Koch et al. | |
| 2003/0195133 | A1 | 10/2003 | Shefer et al. | |
| 2003/0203829 | A1 | 10/2003 | Shefer et al. | |
| 2003/0215417 | A1 | 11/2003 | Uchiyama et al. | |
| 2003/0216488 | A1 | 11/2003 | Uchiyama et al. | |
| 2004/0071742 | A1 | 4/2004 | Popplewell et al. | |
| 2004/0071746 | A1 | 4/2004 | Popplewell et al. | |
| 2004/0072719 | A1 | 4/2004 | Bennett et al. | |
| 2004/0072720 | A1 | 4/2004 | Brain et al. | |
| 2004/0087477 | A1 | 5/2004 | Ness | |
| 2004/0106536 | A1 | 6/2004 | Mane et al. | |
| 2004/0204337 | A1 | 10/2004 | Corona et al. | |
| 2005/0112152 | A1 | 5/2005 | Popplewell et al. | |
| 2005/0153135 | A1 | 7/2005 | Popplewell et al. | |
| 2005/0202990 | A1 | 9/2005 | Caswell et al. | |
| 2005/0245668 | A1 | 11/2005 | Green et al. | |
| 2005/0256027 | A1 | 11/2005 | Heibel et al. | |
| 2006/0074003 | A1 | 4/2006 | Martin et al. | |
| 2006/0094639 | A1 | 5/2006 | Martin et al. | |
| 2006/0287205 | A1 | 12/2006 | Popplewell et al. | |
| 2007/0099817 | A1 | 5/2007 | Smith et al. | |
| 2007/0275866 | A1 * | 11/2007 | Dykstra | 510/101 |

(Continued)

FOREIGN PATENT DOCUMENTS

| | | | |
|---|---|---|---|
| EP | 1393706 | A1 | 3/2004 |
| GB | 1579007 | A | 11/1980 |

(Continued)

OTHER PUBLICATIONS

International Search Report; International Application No. PCT/US2011/030874; date of mailing Jul. 13, 2011; 4 pages.

(Continued)

*Primary Examiner* — John Hardee

(74) *Attorney, Agent, or Firm* — James F. McBride; Steven W. Miller

(57) ABSTRACT

Fabric care composition comprising copolymers exhibit increased fabric active deposition and acceptable composition stringiness.

23 Claims, No Drawings

(56) References Cited

U.S. PATENT DOCUMENTS

| | | | | |
|---|---|---|---|---|
| 2008/0305982 | A1 | 12/2008 | Smets et al. | |
| 2009/0247449 | A1 | 10/2009 | Burdis et al. | |
| 2011/0245141 | A1 | 10/2011 | Gizaw et al. | |
| 2011/0271460 | A1 * | 11/2011 | Karagianni et al. | 8/137 |

FOREIGN PATENT DOCUMENTS

| | | | |
|---|---|---|---|
| WO | 9012862 | A1 | 11/1990 |
| WO | WO 02/074430 | A1 | 9/2002 |
| WO | WO 2004/016234 | A1 | 2/2004 |
| WO | 2007148274 | A2 | 12/2007 |
| WO | WO 2008/005693 | A2 | 1/2008 |
| WO | WO 2010/079100 | A1 * | 7/2010 |

OTHER PUBLICATIONS

"Cationic polymeric thickeners useful in fabric softeners", Research Disclosure Database No. 429116, Jan. 1-31, 2000, p. 136, XP-002646666, ISSN: 0374-4353.

* cited by examiner

FABRIC CARE COMPOSITIONS COMPRISING COPOLYMERS

CROSS-REFERENCES TO RELATED APPLICATIONS

This application claims priority under 35 U.S.C. §119(e) to U.S. Provisional Application Ser. No. 61/320,032 filed Apr. 1, 2010.

FIELD OF THE INVENTION

The present invention relates to fabric care composition comprising copolymers.

BACKGROUND OF THE INVENTION

Copolymers for use in fabric care compositions have been described. US 2006/0094639A1; WO-A-90/12862. Some of these polymers are described for their viscosity modifying benefits. However, there is a continuing need to identify polymers that not only impart viscosity benefits, but also increase deposition of actives to fabric. Such deposition aid benefits allow fabric care actives, such as perfumes and silicones, to have higher efficacy by having their fabric deposition enhanced thereby saving formulation costs. Indeed silicones are important for imparting "feel benefits" imparted to fabric while perfumes are important for imparting "freshness" benefits to fabric. There is also a need to have these polymers stable in low pH since many fabric care compositions, such as fabric softeners, are typically formulated at lower pH (e.g., below pH 7).

SUMMARY OF THE INVENTION

The present invention attempts to solve one more of the needs by providing, in one aspect of the invention, a fabric care composition comprising: a fabric care active; and at least one polymer formed from the polymerization of: a) a water soluble ethylenically unsaturated monomer or blend of monomers comprising at least one cationic monomer and at least one non-ionic monomer (hereinafter "component a)"); b) at least one cross-linking agent in an amount of greater than 0.5 ppm by the weight of component a); and c) at least one chain transfer agent in the amount of greater than 1000 ppm by weight of component a).

In another aspect of the invention, the fabric care composition comprising: a fabric care active; and at least one polymer formed from the polymerization of: a) a water soluble ethylenically unsaturated monomer or blend of monomers comprising at least one cationic monomer and at least one non-ionic monomer; b) at least one cross-linking agent in an amount of greater than 5 ppm by the weight of component a); and c) at least one chain transfer agent in the amount of greater than 100 ppm by weight of component a).

In one embodiment, the polymer comprises at least one cross-linking agent in an amount from 40 ppm to 70 ppm, alternatively from 50 ppm to 60 ppm, alternatively greater than 50 ppm, alternatively about 55 ppm, alternatively combinations thereof by the weight of component a); and c) at least one chain transfer agent in the amount from 1,100 ppm to 3,500 ppm, alternatively from 1500 to 3,250 ppm by weight of component a).

Other aspects of the invention include methods of making fabric care composition comprising the polymer and treating fabric with fabric care compositions comprising the polymer.

DETAILED DESCRIPTION OF THE INVENTION

One aspect of the invention is directed to providing a polymer having a chain transfer agent (CTA) value in a range greater than 1000 ppm by weight of component a). Another aspect of the invention is directed to providing a polymer having a cross linker greater than 5 ppm, alternatively greater than 45 ppm, by weight of component a). Without wishing to be bound by theory, having such a level of CTA and/or level of cross linker surprisingly provides a polymer that in a fabric care composition provides desirable silicone and/or perfume deposition while minimizing undesirable stringiness in the fabric care product.

The polymer may be added to a fabric care composition in a solid or liquid form. An emulsion form is preferred. The emulsion preferably has an average particle size of less than 5 μm (alternatively less than 4 μm, or less than 3 μm, or less than 2 μm, or less than 1 μm). The size may be measured with a Sympatec HELOS laser diffraction apparatus (from Sympatec GmbH, Germany).

The polymer, in one embodiment, comprises from 0.001% to 10% by weight of the fabric care composition. In alternative embodiments, the polymer comprises from 0.01% to 0.3%, alternatively from 0.05% to 0.25%, alternatively from 0.1% to 0.20%, alternatively combinations thereof, of the polymer by weight of the fabric care composition.

In one embodiment of the invention, the component a) comprises 5-95% by weight (wt-%) of at least one cationic monomer and 5-95 wt-% of at least one non-ionic monomer. The weight percentages relate to the total weight of the copolymer.

In yet still another embodiment of the invention, the component a) comprises 50-70 wt-%, preferably 55-65 wt-%, of at least one cationic monomer and 30-50 wt-%, preferably 35-45 wt-%, of at least one non-ionic monomer. The weight percentages relate to the total weight of the copolymer.

Cationic Monomers

Preferred cationic monomers are diallyl dialkyl ammonium halides or compounds according to formula (I):

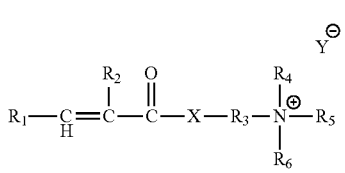

(I)

wherein:

$R_1$ is chosen from hydrogen or methyl, preferably hydrogen;

$R_2$ is chosen hydrogen, or $C_1$-$C_4$ alkyl, preferably $R_2$ is chosen from hydrogen or methyl;

$R_3$ is chosen $C_1$-$C_4$ alkylene, preferably ethylene;

$R_4$, $R_5$, and $R_6$ are each independently chosen from hydrogen, or $C_1$-$C_4$ alkyl, preferably $R_4$, $R_5$, and $R_6$ are methyl;

X is chosen from —O—, or —NH—, preferably —O—; and

Y is chosen from Cl, Br, I, hydrogensulfate or methosulfate, preferably Cl.

The alkyl groups may be linear or branched. The alkyl groups are methyl, ethyl, propyl, butyl, and isopropyl.

In one embodiment, the cationic monomer of formula (I) is dimethyl aminoethyl acrylate methyl chloride.

Non-Ionic Monomers

Preferred non-ionic monomers are compounds of formula (II) wherein

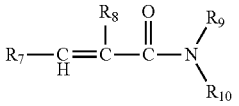

(II)

wherein:

$R_7$ is chosen from hydrogen or methyl, preferably hydrogen;

$R_8$ is chosen from hydrogen or $C_1$-$C_4$ alkyl, preferably hydrogen; and $R_9$ and $R_{10}$ are each independently chosen from hydrogen or $C_1$-$C_4$ alkyl, preferably $R_9$ and $R_{10}$ are each independently chosen from hydrogen or methyl.

In one embodiment, the non-ionic monomer is acrylamide.

Cross-Linking Agent

The cross-linking agent b) contains at least two ethylenically unsaturated moieties. In one embodiment, the cross-linking agent b) contains at least three or more ethylenically unsaturated moieties, preferably at least four or more ethylenically unsaturated moieties.

Suitable cross-linking agents may include divinyl benzene; tetra allyl ammonium chloride; allyl acrylates and methacrylates; diacrylates and dimethacrylates of glycols and polyglycols; butadiene; 1,7-octadiene; allyl-acrylamides and allyl-methacrylamides; bisacrylamidoacetic acid; N,N'-methylene-bisacrylamide and polyol polyallylethers, such as polyallylsaccharose and pentaerythrol triallylether, and mixtures thereof. In one embodiment, the cross-linking agents are chosen from: tetra allyl ammonium chloride; allyl-acrylamides and allyl-methacrylamides; bisacrylamidoacetic acid and N,N'-methylene-bisacrylamide, and mixtures thereof. A preferred cross-linking agent is tetra allyl ammonium chloride.

It is also suitable to use mixtures of cross-linking agents.

The crosslinker(s) is (are) included in the range of from 0.5 ppm to 500 ppm, alternatively from 10 ppm to 400 ppm, more preferred 20 ppm to 200 ppm even more preferred 40 ppm to 100 ppm, even more preferred from 50 ppm to 80 ppm (based on the component a). In one embodiment, the cross linker is greater than 5 ppm (based on component a).

Chain Transfer Agent (CTA)

The chain transfer agent c) is chosen from mercaptanes, malic acid, lactic acid, formic acid, isopropanol and hypophosphites, and mixtures thereof. In one embodiment, the CTA is formic acid.

The CTA is present in a range greater than 100 ppm (based on component a). In one embodiment, the CTA is from 100 ppm to 10,000 ppm, alternatively from 500 ppm to 4,000 ppm, alternatively from 1,000 ppm to 3,500 ppm, alternatively from 1,500 ppm to 3,000 ppm, alternatively from 1,500 ppm to 2,500 ppm, alternatively combinations thereof (based on component a). In yet another embodiment the CTA is greater than 1000 (based on component a). It is also suitable to use mixtures of chain transfer agents.

Molecular Weight Range

In one embodiment, the polymer comprises a Number Average Molecular Weight (Mn) from 1,000,000 Daltons to 3,000,000 Daltons, alternatively from 1,500,000 Daltons to 2,500,000 Daltons.

In another embodiment, the polymer comprises a Weight Average Molecular Weight (Mw) from 4,000,000 Daltons to 11,000,000 Daltons, alternatively from 4,000,000 Daltons to 6,000,00 Daltons.

A. Synthesis of the Cationic Polymer

This non-limiting example illustrates the preparation of a suitable cationic polymer. An 'aqueous phase' of water soluble components is prepared by admixing together the following components:

167.31 g of acrylamide or N,N-dimethylacrylamide;

250.97 g of methyl chloride quaternized dimethylamino ethyl acrylate;

0.64 g of sequesterant;

0.14 g of potassium bromate; and the corresponding amount of Chain Transfer Agent and Crosslinker per Table 1a below.

The aqueous phase is deoxygenated by nitrogen gas for 20 minutes.

A continuous 'oil phase' is prepared by admixing together with 370 g of Exxsol® D100 (dearomatised hydrocarbon solvent), which contains non-ionic emulsifier. The continuous phase is deoxygenated by nitrogen gas for 20 minutes.

The monomer solution is then added to the continuous phase and emulsified with a homogenisator. The temperature of the emulsion is adjusted to 25° C. The mixture is initiated by addition of 0.14 g Sodium bisulphite (2.4% vol/vol solution).

When the exothermic reaction is completed, a water-in-oil emulsion is formed. The emulsion polymer has an average particle size of about 200 nm.

A suitable way to measure molecular weight is using flow field-flow fractionation, Eclipse 2, Multi Light Scattering detector Dawn Eos, and concentration detector R.I. Optilab DSP (Wyatt) (Spacer 350 μl; Injection pump 0.2 ml/min; Nadir 10 kD Reg. Cel. Membrane). The polymer is isolated from the emulsion as a powder and then redissolved in water (3 g/l). The solution is diluted further to 0.3 g/l using 0.5M NaCl solution. Finally, 50 μl of the sample is filtered through 5 μm filter before then injected to flow field-flow fractionation, the multi-angle laser light-scattering with dn/dc 0.150 ml/g.

Tables 1 reports the ionic regain, silicone deposition, and stringiness of fabric care product varying the amount of chain transfer agent.

TABLE la

| Example | Weight Ratio of Acrylamide (to DMAEA[1]) | Weight ratio of DMAEA (to Acrylamide) | Chain Transfer Agent (ppm)[2] | Cross-linker (ppm)[3] | Ionic Regain[4] | Silicone Deposition[5] (ug/g of fabric) | Stringiness of fabric care product[6] |
|---|---|---|---|---|---|---|---|
| 1 | 40 | 60 | 500 | 55 | 27% | 248 | 0.7489 |
| 2 | 40 | 60 | 2,000 | 55 | 6.6% | 287 | 0.2061 |
| 3 | 40 | 60 | 5,000 | 55 | 2.6% | 230 | 0.1527 |

[1]Dimethylamino-ethyl-acrylate, methylchloride.

[2]Formic acid is the chain transfer agent, expressed a part per million (ppm) of based on component a)

[3]Tetraallyl ammonium chloride, expressed a part per million (ppm) of based on component a).

[4]Ionic regain is calculated as (x – y)/x X100, where x is the ionicity measured after applying standard shear and y is the ionicity of the polymer before applying standard shear.

[5]Deposition of polydimethylsiloxane @ 3% in product. See "Methods" section below.

[6]@ 0.2% polymer in product. See "Methods" section below.

TABLE 1b

| Example | Mn × $10^6$ Dalton | Mw × $10^6$ Dalton | Polydispersity Index | Radius of Gyration (nm) | Field Flow Fractionation Recovery |
|---|---|---|---|---|---|
| 1 | 2.6 | 9 | 3.46 | 230 | 85% |
| 2 | 1.7 | 5.6 | 3.29 | 270 | 80% |
| 3 | 2.2 | 6.3 | 2.86 | 245 | 70% |

As shown in Tables 1a and 1b, Example 2—having a chain transfer agent level of 2,000 ppm (i.e., above 1,000 ppm) and having a cross linker level of 55 ppm (i.e. above 5 ppm)—is a preferred polymer in a fabric care composition balancing silicone deposition and mitigating stringiness.

Without wishing to be bound by theory, fabric care compositions (e.g., fabric softeners) typically contain vesicles of cationic actives (e.g., vesicles containing di-tail ester quaternary ammonium compounds). These cationic active are typically dispersed in a vesicle form. The interaction of cationic vesicles to the deposition aid polymer determines (at least in part) the rheology of the system, phase stability, and stringiness. Many factors influence the rheology, phase stability, stringiness of the system. This includes, the size of vesicle, the cationic deposition polymer's molecular weight (e.g., generally the larger the molecular weight, the more viscosity imparted), the size of cationic deposition aid polymer (e.g., generally the lower polydispersity, and a size similar to the cationic vesicles is preferred), and available charges (e.g., interaction between cationic deposition aid polymer and vesicle). As available cationic charge is increased on the cationic deposition aid polymers, the less interaction with the vesicle, due to cationicity of both particles and therefore the less stringiness.

An increase in available charge and molecular weight, increases the deposition of efficiency of hydrophobic actives (such as silicone). Not wishing to be bound by theory, the high charge content interact with carryover surfactant that emulsifying the silicone and drives the actives to the target surface (e.g., fabric).

Ionic Regain

One aspect of the invention provides for the polymer having less than 25% ionic regain, and preferably is cationic. Alternative embodiments include a polymer having a polymer less than 20%, or 15%, or 10%, or less than 8% ionic regain. Alternatively still, the ionic regain is from 1% to 20%, or from 2% to 15%, or from 3% to 10%, or from 4% to 9%, or combinations thereof.

Ionic regain (IR) is calculated as (x−y)/x X100, where x is the ionicity measured after applying standard shear and y is the ionicity of the polymer before applying standard shear.

These IR values are best determined by forming a 1% composition of the polymer is deionised water, allowing this to age for 2 hours and then further diluting it o 0.1% active polymer. The ionicity of the polymer y is measured by Colloid Titration as described by Kock-Light Laboratories Limited in their publication 4/77 KLCD-1. (Alternatively the method described in BP No. 1,579,007 could possibly be used to determine y.) The ionicity after shear, x is determined by measuring by the same technique the ionicity of the solution after subjecting it to standard shear.

The shear is best applied to 200 ml of the solution in a substantially cylindrical pot having a diameter of about 8 cm and provided in its base with a rotatable blade about 6 cm in diameter, one arm of the blade pointing upwards by about 45 degrees and the other downwards by about 45 degrees. The blade is about 1 mm thick and is rotated at 16,500 rpm in the base of the pot for 10 minutes. These conditions are best provided by the use of a Moulinex homogeniser but other satisfactory conditions can be provided using kitchen blenders such as Kenwood, Hamilton Beach, Iona or Osterizer blenders or a Waring Blender.

In practice the precise conditions of shear are relatively unimportant since, provided the degree of shear is of the same order of magnitude as specified, it will be found that IR is not greatly affected by quite large changes in the amount, for instance the duration, of shear, whereas at lower amounts of shear (for instance 1 minute at 16,500 rpm) IR is greatly affected by small changes in shear. Conveniently, therefore, the value of x is determined at the time when, with a high speed blade, further shear provides little or no further change in ionicity. This generally requires shearing for 10 minutes, but sometimes longer periods, e.g., up to 30 minutes with cooling, may be desired.

It should be understood that the defined shear is not shear that is applied to the polymer solution but is instead shear that is applied as an analytical technique to permit definition of the properties of the polymers that may be used in the invention.

B. Synthesis Method.

Another non-limiting preparation of a suitable cationic polymer of the current invention is as follows:

An 'aqueous phase' of water soluble components is prepared by admixing together the following components:

0.3 parts of citric acid-1-hydrate, 0.2 parts of a 40% solution of penta sodium diethylene triamine penta acetic acid (~etralonB~), 17.0 parts of water, 0.2 parts of methylene-bis-acrylamide, 0.63 parts of sodium hypophosphite, and 81.61 parts of methyl chloride quaternised dimethylaminoethylmethacrylate.

An 'oil phase' is prepared by admixing together the following components:

2.8 parts of sorbitan mono-oleate, 21.4 parts of a polymeric stabiliser (20% in solvent), 51.1 parts of 2-ethyl hexyl cocoate, and 24.7 parts of Exxsolm D40 (dearomatised hydrocarbon solvent).

The two phases are mixed together in a ratio of 1 part oil phase to 1.4 parts aqueous phase under high shear to form a water-in-oil emulsion The resulting water-in-oil emulsion is transferred to a reactor equipped with nitrogen sparge tube, stirrer and thermometer. The emulsion is purged with nitrogen to remove oxygen. Polymerisation is effected by addition of a redox couple of sodium metabisulphite and tertiary butyl hydroperoxide.

After the isotherm is completed addition is made of a free radical initiator (vazom 67) and the emulsion held at 85° C. for 75 minutes.

Vacuum distillation is carried out to remove water and volatile solvent to give a final product of 50% polymer solids.

To this product addition is made of 6 parts (by weight of final product) of a fatty alcohol alkoxylate (PPGI-trideceth 6).

Silicones

The polymers of the present invention enhance the deposition of silicone while minimizing undesirable stringiness of the product. One aspect of the invention provides for fabric care compositions comprising a silicone. The term silicone is used herein in the broadest sense to include a silicone or silicone comprising compound that imparts a desirable benefit to fabric (upon using a fabric care composition of the present invention). "Silicone" preferably refers to emulsified and/or microemulsified silicones, including those that are commercially available and those that are emulsified and/or microemulsified in the composition, unless otherwise described.

In one embodiment, the silicone is a polydialkylsilicone, alternatively a polydimethyl silicone (polydimethyl siloxane or "PDMS"), or a derivative thereof. In another embodiment, the silicone is chosen from an aminofunctional silicone, alkyloxylated silicone, ethoxylated silicone, propoxylated silicone, ethoxylated/propoxylated silicone, quaternary silicone, or combinations thereof. Levels of silicone in the fabric care composition may include from about 0.01% to about 20%, alternatively from about 0.1% to about 10%, alternatively from about 0.2% to about 5%, alternatively from about 0.4% to about 3%, alternatively from about 1% to about 5%, alternatively from about 2% to about 3%, alternatively combinations thereof, by weight of the fabric care composition.

Some non-limiting examples of silicones which are useful in the present invention are: non-volatile silicone fluids such as polydimethyl siloxane gums and fluids; volatile silicone fluid which can be a cyclic silicone fluid of the formula $[(CH_3)_2SiO]_n$ where n ranges between about 3 to about 7, preferably about 5, or a linear silicone polymer fluid having the formula $(CH_3)_3SiO[(CH_3)_2SiO]_mSi(CH_3)_3$ where m can be 0 or greater and has an average value such that the viscosity at 25° C. of the silicone fluid is preferably about 5 centistokes or less.

One type of silicone that may be useful in the composition of the present invention is polyalkyl silicone with the following structure:

$$A—(Si(R_2)—O—[Si(R_2)—O—]_q—Si(R_2)—A$$

The alkyl groups substituted on the siloxane chain (R) or at the ends of the siloxane chains (A) can have any structure as long as the resulting silicones remain fluid at room temperature.

Each R group preferably is alkyl, hydroxy, or hydroxyalkyl group, and mixtures thereof, having less than about 8, preferably less than about 6 carbon atoms, more preferably, each R group is methyl, ethyl, propyl, hydroxy group, and mixtures thereof. Most preferably, each R group is methyl. Aryl, alkylaryl and/or arylalkyl groups are not preferred. Each A group which blocks the ends of the silicone chain is hydrogen, methyl, methoxy, ethoxy, hydroxy, propoxy, and mixtures thereof, preferably methyl. q is preferably an integer from about 7 to about 8,000.

One type of silicones include polydimethyl siloxanes and preferably those polydimethyl siloxanes having a viscosity of from about 10 to about 1000,000 centistokes at 25° C. Mixtures of volatile silicones and non-volatile polydimethyl siloxanes are also preferred. Preferably, the silicones are hydrophobic, non-irritating, non-toxic, and not otherwise harmful when applied to fabric or when they come in contact with human skin. Further, the silicones are compatible with other components of the composition are chemically stable under normal use and storage conditions and are capable of being deposited on fabric.

Other useful silicone materials, may include materials of the formula:

$$HO—[Si(CH_3)_2—O]_x—\{Si(OH)[CH_2)_3—NH—(CH_2)_2—NH_2]O\}_y—H$$

wherein x and y are integers which depend on the molecular weight of the silicone, preferably having a viscosity of from about 10,000 cst to about 500,000 cst at 25° C. This material is also known as "amodimethicone". Although silicones with a high number, e.g., greater than about 0.5 millimolar equivalent of amine groups can be used, they are not preferred because they can cause fabric yellowing.

Similarly, silicone materials which may be used correspond to the formulas:

$$(R^1)_aG_{3-a}\text{-}Si—(—OSiG_2)_n\text{-}(OSiG_b(R^1)_{2-b})_m—O—SiG_{3-a}(R^1)_a$$

wherein G is selected from the group consisting of hydrogen, OH, and/or $C_1$-$C_5$ alkyl; a denotes 0 or an integer from 1 to 3; b denotes 0 or 1; the sum of n+m is a number from 1 to about 2,000; $R^1$ is a monovalent radical of formula $CpH_{2p}$ L in which p is an integer from 2 to 4 and L is selected from the group consisting of:

a) $—N(R^2)CH_2—CH_2—N(R^2)_2$;

b) $—N(R^2)_2$;

c) $—N+(R^2)_3A^-$; and d) $—N+(R^2)CH_2—CH_2N+H_2A^-$ wherein each $R^2$ is chosen from the group consisting of hydrogen, a $C_1$-$C_5$ saturated hydrocarbon radical, and each $A^-$ denotes compatible anion, e.g., a halide ion; and $$R^3—N+(CH_3)_2—Z—[Si(CH_3)_2O]_f—Si(CH_3)_2—Z—N+(CH_3)_2—R^3.2CH_3COO^-$$

wherein a) $z=—CH_2—CH(OH)—CH_2O—CH_2)_2—$ b) $R^3$ denotes a long chain alkyl group; and c) f denotes an integer of at least about 2.

In the formulas herein, each definition is applied individually and averages are included.

Another silicone material may include those of the following formula:

$$(CH_3)_3—Si—[OSi(CH_3)_2]_n—\{—O—Si(CH_3)[CH_2)_3—NH—(CH_2)_2—NH_2]\}_mOSi(CH_3)_3$$

wherein n and m are the same as before. The preferred silicones of this type are those which do not cause fabric discoloration.

In one embodiment, the silicone is an organosiloxane polymers. Non-limiting examples of such silicones include U.S. Pat. Nos. 6,815,069; 7,153,924; 7,321,019; and 7,427,648.

Alternatively, the silicone material can be provided as a moiety or a part of a non-silicone molecule. Examples of such materials are copolymers containing silicone moieties, typically present as block and/or graft copolymers.

Perfumes

The polymers of the present invention enhance the deposition of perfume while minimizing undesirable stringiness of the product. One aspect of the invention provides for fabric care compositions comprising a perfume. As used herein the term "perfume" is used to indicate any odoriferous material that is subsequently released into the aqueous bath and/or onto fabrics contacted therewith. The perfume will most often be liquid at ambient temperatures. A wide variety of chemicals are known for perfume uses, including materials such as aldehydes, ketones, and esters. More commonly, naturally occurring plant and animal oils and exudates comprising complex mixtures of various chemical components are known for use as perfumes. The perfumes herein can be relatively simple in their compositions or can comprise highly sophisticated complex mixtures of natural and synthetic chemical components, all chosen to provide any desired odor. Examples of perfumes are described, for example, in US 2005/0202990 A1, from paragraphs 47 to 81. Examples of neat perfumes are disclosed in U.S. Pat. Nos. 5,500,138; 5,500,154; 6,491,728; 5,500,137 and 5,780,404. Perfume fixatives and/or perfume carrier materials may also be included. US 2005/0202990 A1, from paragraphs 82-139. Suitable perfume delivery systems, methods of making certain perfume delivery systems and the uses of such perfume delivery systems are disclosed in USPA 2007/0275866 A1 In one embodiment, the fabric care composition comprises 0.01% to 5% (alternatively from 0.5% to 3%, or from 1% to 2%) neat perfume by weight of the fabric care composition.

In one embodiment, the compositions of the present invention comprises perfume oil encapsulated in a perfume microcapsule (PMC), preferable a friable PMC. Suitable perfume microcapsules may include those described in the following references: US 2003-215417 A1; US 2003-216488 A1; US 2003-158344 A1; US 2003-165692 A1; US 2004-071742 A1; US 2004-071746 A1; US 2004-072719 A1; US 2004-072720 A1; EP 1393706 A1; US 2003-203829 A1; US 2003-195133 A1; US 2004-087477 A1; US 2004-0106536 A1; US 2008-0305982 A1; US 2009-0247449 A1; U.S. Pat. Nos. 6,645,479; 6,200,949; 5,145,842; 4,882,220; 4,917,920; 4,514,461; 4,234,627; 4,081,384; U.S. RE 32713; U.S. Pat. Nos. 4,234,627; 7,119,057. In another embodiment, the perfume microcapsule comprises a friable microcapsule. In another embodiment, the shell comprising an aminoplast copolymer, esp. melamine-formaldehyde or urea-formaldehyde or cross-linked melamine formaldehyde or the like. Capsules may be obtained from Appleton Papers Inc., of Appleton, Wis. USA. Formaldehyde scavengers may also be used.

Fabric Softener Active

Liquid fabric softening compositions (such as those contained in DOWNY) comprise a fabric softening active. One class of fabric softener actives includes cationic surfactants. Examples of cationic surfactants include quaternary ammonium compounds. Exemplary quaternary ammonium compounds include alkylated quaternary ammonium compounds, ring or cyclic quaternary ammonium compounds, aromatic quaternary ammonium compounds, diquaternary ammonium compounds, alkoxylated quaternary ammonium compounds, amidoamine quaternary ammonium compounds, ester quaternary ammonium compounds, and mixtures thereof. A final fabric softening composition (suitable for retail sale) will comprise from about 1% to about 30%, alternatively from about 10% to about 25%, alternatively from about 15 to about 21%, alternatively from about 1% to about 5%, alternatively combinations thereof, of fabric softening active by weight of the final composition. Fabric softening compositions, and components thereof, are generally described in US 2004/0204337. In one embodiment, the fabric softening composition is a so called rinse added composition. In such embodiment, the composition is substantially free of detersive surfactants, alternatively substantially free of anionic surfactants. In another embodiment, the pH of the fabric softening composition is acidic, for example between pH 2 and 5, alternatively between 2 to 4, alternatively between 2 and 3, alternatively combinations thereof. In yet another embodiment, the fabric softening active is DEEDMAC (e.g., ditallowoyl ethanolester dimethyl ammonium chloride). DEEDMAC means mono and di-fatty acid ethanol ester dimethyl ammonium quaternaries, the reaction products of straight chain fatty acids, methyl esters and/or triglycerides (e.g., from animal and/or vegetable fats and oils such as tallow, palm oil and the like) and methyl diethanol amine to form the mono and di-ester compounds followed by quaternization with an alkylating agent. In one embodiment, the fabric softener active is a bis-(2-hydroxyethyl)-dimethylammonium chloride fatty acid ester having an average chain length of fatty acid moieties of from 16 to 18 carbon atoms, and having an iodine value, calculated for the free fatty acid from 0 to 50, preferably from 15 to 25.

Polyethyleneimines (PEI)

One aspect of the invention provides using the polymers of the present invention in combination with polymeric amines based upon homopolymer polyethyleneimines ("PEI"). A general formula of PEI is: $—(CH_2—CH_2—NH)_n—$; n=10–$10^5$. Homopolymeric PEIs may be branched, spherical polyamines with defined ratios of primary, secondary, and tertiary amine functions. PEI can be made by the polymerization of ethyleneimine monomer. The PEI of the present invention is not entirely a linear polymer, but rather a partly branched polymer comprising primary, secondary, and tertiary amines.

The PEI may comprise a primary amine rate from about 30% to about 40%, alternatively from about 32% to about 38%, alternatively from about 34% to about 36%, alternatively combinations thereof. The PEI may comprise a secondary amine rate (NMR ($^{13}C$)) from about 30% to about 40%, alternatively from about 32% to about 38%, alternatively from about 34% to about 36%, alternatively combinations thereof. The PEI may comprise a tertiary amine rate from about 25% to about 35%, alternatively from about 27% to about 33%, alternatively from about 29% to about 31%, alternatively combinations thereof.

The PEI may have a molecular weight range (Mw), based on light scattering, from 2,000 to 11,000, alternatively from 2,500 to 8,000, alternatively from 3,000 to 7,000, alternatively from 4,000 to 6,000, alternatively combinations thereof.

The PEI may have a charge density (meq/g) at pH4.5 from 15 to 19, alternatively from 16 to 18, alternatively about 17, alternatively combinations thereof.

The PEI may comprise from 0.01% to 5%, alternatively from 0.05% to 1%, alternatively from 0.1% to 0.25%, alternatively combinations thereof, by weight of the fabric care composition.

Examples of PEI may include LUPASOL G100 series of compounds from BASF. The Table below summarizes the Number Average Molecular Weight (Mn), Weight Average Molecular Weight (Mw), Z-average Molecular Weight (Mz), and polydispersity index (PDI):

LUPASOL Molecular Weight Table:

| | Lupasol G100 (50% active) | Lupasol G100B (47.7% active) | Lupasol G100B (45.4% active) |
|---|---|---|---|
| Mn | 6.2336E+03 | 9.7160E+03 | 1.2453E+04 |
| Mw | 1.9543E+04 | 6.8277E+04 | 6.4359E+04 |
| Mz | 1.3877E+05 | 1.5975E+05 | 2.0534E+05 |
| PDI | 3.14 | 7.03 | 5.17 |

Treating Fabric

The fabric care compositions of the present invention may be used to treat fabric by administering a dose to a laundry washing machine or directly to fabric (e.g., spray). The fabric care composition may be in the form of a powder or liquid. The composition may be administered to the washing machine as a unit dose or dispensed from a container (e.g., dispensing cap) containing multiple doses. An example of a unit dose is a composition encased in a water soluble polyvinylalcohol film.

Methods

Methods for assessing (i) silicone deposition and (ii) stringiness of fabric care product are detailed below.

(i) Assessing Silicone Deposition on Fabric. Fabrics are treated with a liquid fabric softener of the preset invention that containing (17.5% bis-(2-hydroxyethyl)-dimethylammonium chloride fatty acid ester, 1% polydimethylsiloxane, and 0.1% of the respective polymer (i.e., Examples 1-3)—all by weight of the liquid fabric softener composition) during the rinse cycle. After completion of the rinse, fabrics are dried in dryers, the fabric is cut into swatches are and analyzed for the amount of silicone deposited per gram of fabric. The extraction solvent is selected. For non-polar silicones, the extraction solvent is toluene/Methyl isobutyl ketone (50%//50%). For polar silicones, the extraction is Methyl isobutyl ketone/methanol/AE3S (84.45%/15.5%/0.05%). The amount of silicone deposited is determined by the ICP/MS.

ii) Assessing Stringiness of the Fabric Care Product. Cationic deposition aid polymers are dissolved in water and added to liquid fabric softener that containing (15.3% bis-(2-hydroxyethyl)-dimethylammonium chloride fatty acid ester, and 0.2% of the respective polymer (i.e., Examples 1-3)—all by weight of the liquid fabric softener composition). Each mixture is brought to a pH of approximately 3.5 with 1.0N HCl. Stringiness is measured using the Capillary Breakup Extensional Rheometer (Thermo Fisher Scientific HAAKE CaBER™ 1). The instrument settings are adjusted as in the below table using the required software supplied by the manufacturer. After the sample is loaded and the measurement initiated, the data is collected automatically as described in the detailed HAAKE CaBER 1 Operating Manual supplied with the instrument or available on the online manufacturer's website. The data is the critical time to breakup (expressed in seconds).

Setting Specifications used on the Thermo Fisher Scientific HAAKE CaBER™ 1:

| | |
|---|---|
| Hencky strain: | 1.84 |
| Shear Viscosity range: | $10\text{-}10^6$ mPas |
| Plate/Sample diameter: | Standard = 6 mm |
| Temperature range: | Ambient |
| Diameter resolution: | 0.1 nmm |
| System response time: | 10 ms |
| Drive system used: | Linear drive |
| Sample start height: | 0.996 mm |
| Sample end height: | 6.29 mm |
| Sample data collection time: | 0 s-6 s |
| Replicates averaged for one sample result | 5 |

EXAMPLES

The following are non-limiting examples of the fabric care compositions of the present invention.

| (% wt) | I | II | III | IV | V | VI | VII |
|---|---|---|---|---|---|---|---|
| FSA[a] | 12 | 21 | 18 | 14 | 12 | 16 | 12 |
| FSA[b] | — | — | — | — | — | — | — |
| FSA[c] | — | — | — | — | — | — | — |
| FSA[z] | | | | | | — | — |
| Low MW alcohol | 1.95 | 3.0 | 3.0 | 2.28 | 2.28 | 1.50 | 2.68 |
| Rheology modifier[d,e,] | 1.25[d] | — | 0.2[e] | — | 0.2[e] | — | — |
| Perfume | 1.50 | 2.3 | 2.0 | 1.50 | 1.50 | 2.20 | 1.50 |
| Perfume encapsulation | 0.6 | 0.3 | 0.4 | — | 0.15 | 0.4 | 0.25 |
| Phase Stabilizing Polymer[f] | 0.25 | — | — | 0.142 | 0.25 | — | 0.25 |
| Suds Suppressor[g] | — | — | — | — | — | — | — |
| Calcium Chloride | 0.10 | 0.12 | 0.1 | 0.45 | 0.55 | 0.350 | 0.545 |
| DTPA[h] | 0.005 | 0.005 | 0.005 | 0.005 | 0.005 | 0.005 | 0.007 |
| Preservative (ppm)[i] | 5 | 5 | 5 | 5 | 5 | 5 | 5 |
| Antifoam[j] | 0.015 | 0.15 | 0.11 | 0.011 | 0.011 | 0.011 | 0.011 |
| Polyethylene imines[l] | 0.15 | 0.05 | — | 0.1 | — | — | 0.1 |
| Cationic acrylate acrylamide copolymer[m] | 0.1 | 0.1 | 0.2 | 0.05 | 0.1 | 0.1 | 0.1 |
| PDMS emulsion[n] | — | 0.5 | 1 | 2.0 | — | — | — |
| Stabilizing Surfactant[o] | — | — | 0.5 | 0.2 | 0.2 | 0.1 | 0.2 |
| Organosiloxane polymer[p] | 5 | — | — | — | — | 2 | — |
| Amino-functional silicone | — | — | — | — | 5 | — | 2 |
| Dye (ppm) | 40 | 11 | 30 | 40 | 40 | 40 | 40 |
| Ammonium Chloride | 0.10 | 0.12 | 0.12 | 0.10 | 0.10 | 0.10 | 0.115 |
| HCl | 0.010 | 0.01 | 0.10 | 0.010 | 0.010 | 0.010 | 0.010 |
| Deionized Water | Balance | Balance | Balance | Balance | Balance | Balance | Balance |

| (% wt) | VIII | IX | X | XI | XII |
|---|---|---|---|---|---|
| FSA[a] | 5 | 5 | — | — | — |
| FSA[b] | — | — | 3.00 | — | — |
| FSA[c] | — | — | — | 7 | — |
| FSA[z] | — | — | — | — | 12 |
| Low MW alcohol | 0.81 | 0.81 | 0.3 | 0.9 | — |
| Rheology modifier[d,e,] | 0.42[d] | 0.25[e] | 0.5[d] | 0.70[d] | — |
| Perfume | 0.60 | 0.60 | 1.30 | 0.8-1.5 | 2.4 |
| Perfume encapsulation | — | 0.3 | 0.1 | — | — |
| Phase Stabilizing Polymer[f] | — | — | — | — | — |
| Suds Suppressor[g] | 0.1 | — | — | 0.1 | — |
| Calcium Chloride | — | — | — | 0.1-0.15 | 0.05 |
| DTPA[h] | 0.002 | 0.002 | 0.20 | — | 0.05 |
| Preservative (ppm)[i] | 5 | 5 | — | 250 | 75 |
| Antifoam[j] | 0.015 | 0.015 | — | — | 0.005 |
| Polyethylene imines[l] | — | 0.05 | — | — | — |
| Cationic acrylate acrylamide copolymer[m] | 0.1 | 0.1 | 0.1 | 0.1-0.2 | 0.1 |

-continued

| | | | | | |
|---|---|---|---|---|---|
| PDMS emulsion[n] | 0.25 | — | — | — | — |
| Stabilizing Surfactant[o] | — | — | — | — | — |
| Organosiloxane polymer[p] | — | — | — | 0-5.0 | 3.0 |
| Amino-functional silicone | — | — | — | 0-5.0 | — |
| Dye (ppm) | 30 | 30 | 11 | 30-300 | 30-300 |
| Ammonium Chloride | — | — | — | — | — |
| HCl | 0.011 | 0.011 | 0.016 | 0.025 | 0.01 |
| Deionized Water | Balance | Balance | Balance | Balance | Balance |

[a]N,N-di(tallowoyloxyethyl)-N,N-dimethylammonium chloride.

[b]Methyl bis(tallow amidoethyl)2-hydroxyethyl ammonium methyl sulfate.

[c]Reaction product of Fatty acid with Methyldiethanolamine in a molar ratio 1.5:1, quaternized with Methylchloride, resulting in a 1:1 molar mixture of N,N-bis(stearoyl-oxy-ethyl) N,N-dimethyl ammonium chloride and N-(stearoyl-oxy-ethyl) N,-hydroxyethyl N,N dimethyl ammonium chloride.

[z]The Reaction product of fatty acid with an iodine value of 40 with methyl/diisopropylamine in a molar ratio from about 1.86 to 2.1 fatty acid to amine and quaternized with methyl sulfate.

[d]Cationic high amylose maize starch available from National Starch under the trade name HYLON VII ®.

[e]Cationic polymer available from Ciba under the name Rheovis CDE.

[f]Copolymer of ethylene oxide and terephthalate having the formula described in U.S. Pat. No. 5,574,179 at col. 15, lines 1-5, wherein each X is methyl, each n is 40, u is 4, each R1 is essentially 1,4-phenylene moieties, each R2 is essentially ethylene, 1,2-propylene moieties, or mixtures thereof.

[g]SE39 from Wacker.

[h]Diethylenetriaminepentaacetic acid.

[i]Koralone B-119 available from Rohm and Haas Co. "PPM" is "parts per million."

[j]Silicone antifoam agent available from Dow Corning Corp. under the trade name DC2310.

[l]Polyethylene imines available from BASF under the trade name Lupasol.

[m]Cationic acrylate acrylamide copolymer of Example 2.

[n]Polydimethylsiloxane emulsion from Dow Corning under the trade name DC346.

[o]Non-ionic such as TWEEN 20 or cationic surfactant as Berol 648 and Ethoquad C 25 both from Akzo Nobel.

[p]Organosiloxane polymer condensate made by reacting hexamethylenediisocyanate (HDI), and a,w silicone diol and 1,3-propanediamine, N'-(3-(dimethylamino)propyl)-N,N-dimethyl- Jeffcat Z130) or N-(3-dimethylaminopropy1)-N,Ndiisopropanolamine (Jeffcat ZR50) commercially available from Wacker Silicones, Munich, Germany.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A fabric care composition comprising:

(i) a fabric care active; and (ii) at least one polymer formed from the polymerisation of:

a) a water soluble ethylenically unsaturated monomer or blend of monomers comprising at least one cationic monomer and at least one non-ionic monomer;

wherein the cationic monomer is a compound according to formula (I):

(I)

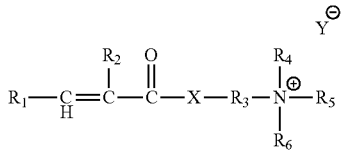

wherein:

$R_1$ is chosen from hydrogen or methyl;

$R_2$ is chosen hydrogen, or $C_1$-$C_4$ alkyl;

$R_3$ is chosen $C_1$ -$C_4$ alkylene;

$R_4$, $R_5$, and $R_6$ are each independently chosen from hydrogen, or $C_1$ -$C_4$ alkyl;

X is chosen from —O—, or —NH—; and

Y is chosen from Cl, Br, I, hydrogensulfate, or methosulfate, wherein the non-ionic monomer is a compound of formula (II):

(II)

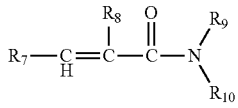

wherein:

$R_7$ is chosen from hydrogen or methyl;

$R_8$ is chosen from hydrogen or $C_1$-$C_4$ alkyl; and $R_9$ and $R_{10}$ are each independently chosen from hydrogen or $C_1$-$C_4$ alkyl;

b) at least one cross-linking agent in an amount from 0.5 ppm to 500 ppm by the weight of component a), and c) at least one chain transfer agent in the amount of ppm2,000 ppm to 5,000 ppm relative to component a).

2. A fabric care composition according to claim 1 wherein:

(i) said fabric care active comprises a silicone or perfume; and (ii) at least one polymer formed from the polymerisation of:

a) a water soluble ethylenically unsaturated monomer or blend of monomers comprising at least one cationic monomer and at least one non-ionic monomer;

wherein the cationic monomer is a compound according to formula (I):

(I)

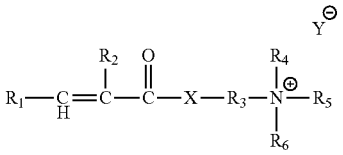

wherein:

$R_1$ is hydrogen;

$R_2$ is chosen from hydrogen or methyl ;

$R_3$ is ethylene;

$R_4$, $R_5$, and $R_6$ are methyl;

X is —O—; and

Y is Cl;

wherein the non-ionic monomer is a compound of formula (II):

(II)

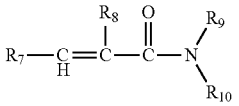

wherein:

$R_7$ is hydrogen;

$R_8$ is hydrogen; and $R_9$ and $R_{10}$ are each independently chosen from hydrogen or methyl b) at least one cross-linking agent in an amount from 0.5 ppm to 500 ppm by the weight of component a), and c) at least one chain transfer agent in the amount of 2,000 ppm to 5,000 ppm relative to component a).

3. The composition of claim 1, wherein the component a) comprises 50-70 wt-% of the non-ionic monomer.

4. The composition of claim 3, wherein the component a) comprises 35-45 wt-% of the non-ionic monomer.

5. The composition of claim 1, wherein the cross-linking agent contains contain at least three or more ethylenically unsaturated moieties.

6. The composition of claim 5, wherein the cross-linking agent contains contain tetra allyl ammonium chloride.

7. The composition of claim 1, wherein the chain transfer agent is formic acid.

8. The composition of claim 1, wherein the fabric care composition comprises from 0.01% to 0.3% of the polymer by weight of the fabric care composition.

9. The composition of claim 8, wherein the fabric care composition comprises from 0.05% to 0.25% of the polymer by weight of the fabric care composition.

10. The composition of claim 9, wherein the fabric care composition comprises from 0.1% to 0.20% of the polymer by weight of the fabric care composition.

11. The composition of claim 1, wherein the pH is from 2 to 5.

12. The composition of claim 1, comprising 1% to 49% of a quaternary ammonium comprising fabric softening active.

13. The composition of claim 1, comprising a friable perfume microcapsule.

14. The composition of claim 1, comprising polyethyleneimines.

15. The composition of claim 1, comprising 0.5% to 2% of neat perfume by weight of the fabric care composition.

16. The composition of claim 1, comprising 1% to 4% of a silicone by weight of the fabric care composition, preferably wherein the silicone is a polydimethylsiloxane or an organosiloxane polymer.

17. The composition of claim 16, comprising wherein the silicone comprise a polydimethylsiloxane or an organosiloxane polymer.

18. The composition of claim 1, wherein the polymer has ionic regain from 1.6% to 25, wherein said ionic regain is calculated as (x-y)/x X100, where x is the ionicity measured after applying standard shear and y is the ionicity of the polymer before applying standard shear.

19. The composition of claim 18, wherein the polymer has ionic regain from 4% to 9%, wherein said ionic regain is calculated as (x-y)/x X100,where x is the ionicity measured after applying standard shear and y is the ionicity of the polymer before applying standard shear.

20. The composition of claim 1, wherein the polymer comprises a Number Average Molecular Weight (Mn) 1,000,000 to 3,000,000 Daltons and wherein the polymer comprises from a Weight Average Molecular Weight (Mw) from 4,000,000 to 11,000,000 Daltons.

21. The composition of claim 20, wherein the polymer comprises a Number Average Molecular Weight (Mn) 1,500,000 to 2,500,00 Daltons, and wherein the polymer comprises from a Weight Average Molecular Weight (Mw) from 4,000,000 to 6,000,00 Daltons.

22. A fabric care composition comprising:

(i) a fabric are active; and (ii) at least one polymer formed from the polymerisation of:

a) a water soluble ethylenically unsaturated monomer or blend of monomers comprising at least one cationic monomer and at least one non-ionic monomer;

wherein the cationic monomer is a compound according to formula (I):

(I)

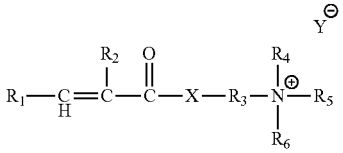

wherein:

$R_1$ is chosen from hydrogen or methyl;

$R_2$ is chosen hydrogen, or $C_1$-$C_4$ alkyl;

$R_3$ is chosen $C_1$-$C_4$ alkylene;

$R_4$, $R_5$, and $R_6$ are each independently chosen from hydrogen, or $C_1$-$C_4$ alkyl;

X is chosen from —O—, or —NH—; and

Y is chosen from Cl, Br, I, hydrogensulfate, or methosulfate;

wherein the non-ionic monomer is a compound of formula (II):

(II)

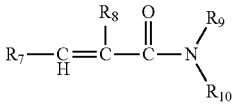

wherein:

$R_7$ is chosen from hydrogen or methyl;

$R_8$ is chosen from hydrogen or $C_1$-$C_4$ alkyl; and $R_9$ and $R_{10}$ are each independently chosen from hydrogen or $C_1$-$C_4$ alkyl;

b) at least one cross-linking agent in an amount greater than 5 ppm by the weight of component a), and c) at least one chain transfer agent in the amount of 2,000 ppm to 5,000 ppm relative to component a).

23. A fabric care composition according to claim 22 comprising:

(i) the fabric care active comprises a silicone or perfume; and (ii) at least one polymer formed from the polymerisation of:

a) a water soluble ethylenically unsaturated monomer or blend of monomers comprising at least one cationic monomer and at least one non-ionic monomer;

wherein the cationic monomer is a compound according to formula (I):

(I)

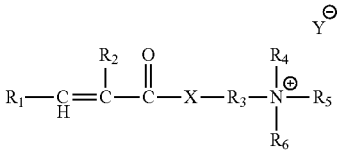

wherein:

$R_1$ is hydrogen;

$R_2$ is chosen from hydrogen or methyl;

$R_3$ is ethylene;

$R_4$, $R_5$, and $R_6$ are methyl;

X is —O—; and

Y is Cl;

wherein the non-ionic monomer is a compound of formula (II):

(II)

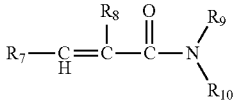

wherein:

$R_7$ is hydrogen;

$R_8$ is hydrogen; and $R_9$ and $R_{10}$ are each independently chosen from hydrogen or methyl;

b) at least one cross-linking agent in an amount from 50 ppm to 60 ppm by the weight of component a), and c) at least one chain transfer agent in the amount of from 2,000 ppm to 5,000 ppm relative to component a).

* * * * *